United States Patent [19]

Simjian

[11] Patent Number: 4,634,130

[45] Date of Patent: Jan. 6, 1987

[54] GOLF PRACTICE PUTTING DEVICE

[75] Inventor: Luther G. Simjian, Fort Lauderdale, Fla.

[73] Assignee: Command Automation, Inc., Fort Lauderdale, Fla.

[21] Appl. No.: 774,963

[22] Filed: Sep. 11, 1985

[51] Int. Cl.[4] ..... A63B 69/36

[52] U.S. Cl. ..... 273/176 FA; 273/DIG. 26

[58] Field of Search ..... 273/178 R, 179 C, 180, 273/176 F, 176 FA, 176 FB, 176 FC, 176 J

[56] References Cited

U.S. PATENT DOCUMENTS

| | | | |
|---|---|---|---|
| 815,649 | 3/1906 | Smith | 273/178 R |
| 1,479,673 | 1/1924 | Phelps | 273/180 |
| 1,581,092 | 4/1926 | Brooks | 273/178 R |
| 2,057,504 | 10/1936 | Schafer | 273/176 FB X |
| 2,334,540 | 11/1943 | Buffham | 273/179 C |
| 3,059,931 | 10/1962 | Garcia | 273/179 C |
| 3,424,463 | 1/1969 | Matthews | 273/176 F X |
| 3,434,721 | 3/1969 | Travers | 273/176 F X |
| 4,336,939 | 6/1982 | Krumlauf | 273/176 FB X |

FOREIGN PATENT DOCUMENTS

| | | | |
|---|---|---|---|
| 311017 | 5/1929 | United Kingdom | 273/179 C |

*Primary Examiner*—George J. Marlo

[57] ABSTRACT

A golf practice putting device comprises an elongated mat upon which a golf ball is propelled from one end to an opposite elevated end. A cup simulating aperture is provided at such opposite end, and a ball entering the aperture is conveyed to a first receptacle disposed behind the aperture where the ball is retained. Balls propelled beyond the aperture and missing the aperture, reach a trough shaped portion where the balls fall into a second receptacle also disposed behind the aperture and are retained therein. By comparing the quantity of balls in the respective receptacles, a player's score can be determined. Also counting means are disposed to automatically count the balls entering the aperture and received in one of said receptacles.

8 Claims, 5 Drawing Figures

GOLF PRACTICE PUTTING DEVICE

BRIEF SUMMARY OF THE INVENTION

This invention relates to golf practice putting devices and, more specifically, refers to devices of this kind wherein a golf ball, or golf ball simulating device, is stroked for rolling over a mat toward a predetermined location which may contain a cup for receiving such ball.

Practice devices of this type are well known in the prior art, the following patents being representative:

| U.S. Pat. No. | INVENTOR | DATE |
|---|---|---|
| 815,649 | Smith | Mar. 20, 1906 |
| 1,338,963 | Rolfe | May 4, 1920 |
| 1,612,291 | Jackson | Dec. 28, 1926 |
| 1,679,374 | Reirden | Aug. 7, 1928 |
| 2,460,080 | Gerding | Jan. 25, 1949 |
| 3,038,726 | Hesidence | Jun. 12, 1962 |
| 3,342,495 | Wasley | Sept. 19, 1967 |

The present golf practice device concerns an improved putting practice arrangement wherein a ball is driven along an inclined mat plane toward a cup disposed on a level elevated portion of the mat. The cup is in cooperative relationship with a receptacle which receives balls from the cup. Balls missing the cup and rolling beyond the cup area are received in another receptacle. By comparing the quantity of balls in the receptacles, the degree of skill of the person using this device is immediately apparent. In addition, a counter may be provided to automatically count the quantity of balls passing through the cup.

One of the important objects of this invention, therefore, is the provision of a new and improved golf practice putting device.

Another important object of this invention is the provision of an improved golf practice device using an elongated mat which is raised at one end and contains a cup at the elevated end, and a receptacle for receiving balls which roll beyond the cup.

Another important object of this invention is the provision of a golf practice device using an elongated mat which is raised at one end and contains an aperture at such elevated end, balls putted and falling in the aperture are conveyed to a first receptacle while balls missing the cup and rolling beyond the cup fall into a second receptacle.

A further important object of this invention is the provision of a golf practice putting device which is simple, but preserves the competitive spirit among one or more players.

Further and still other objects of this invention will be more clearly apparent from the following description when read in conjunction with the accompanying drawings.

DETAILED DESCRIPTION OF THE INVENTION

Figure 2:
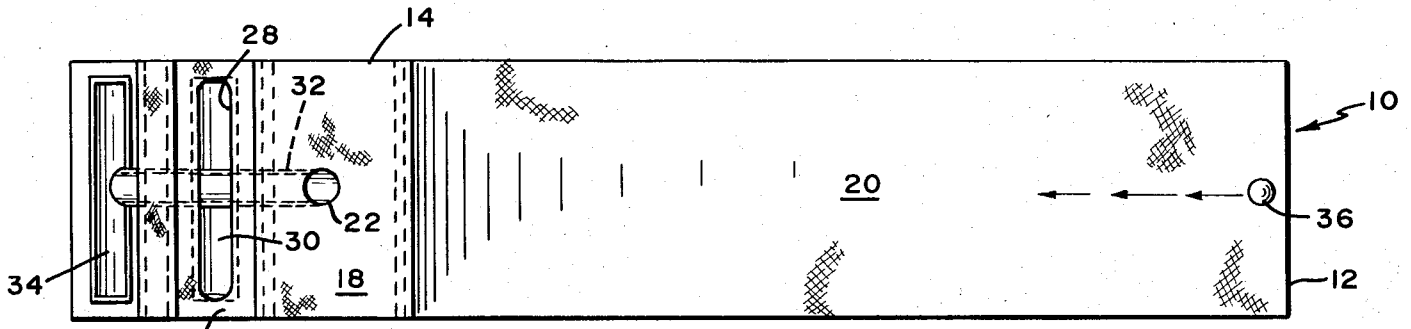
FIG. 2 is a top plan view of the device shown in FIG. 1.
Figure 1:
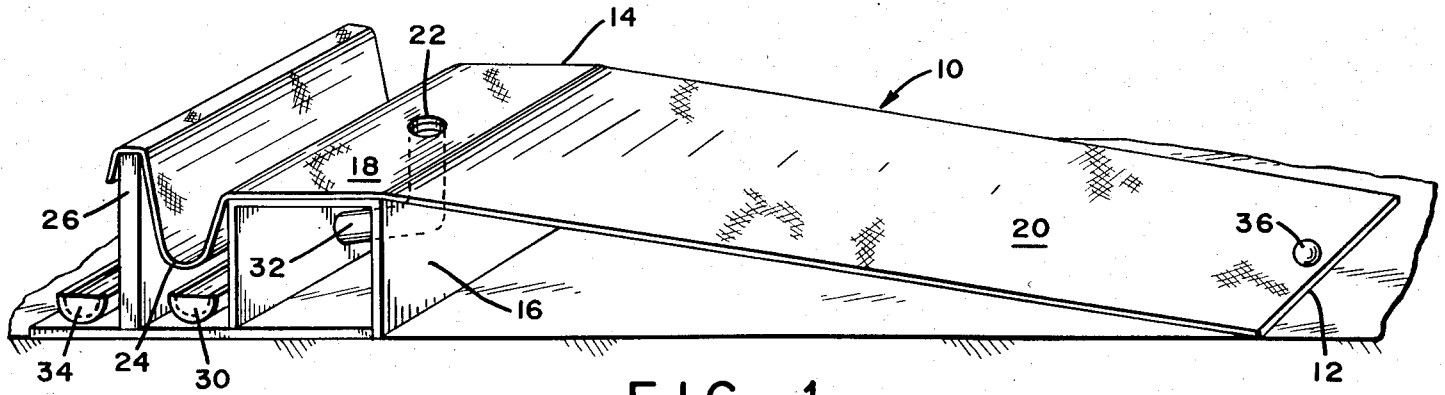
FIG. 1 is a perspective view of my new and improved golf practice putting device.

Referring not to the figures and FIGS. 1 and 2 in particular, numeral 10 denotes an elongated mat with relatively heavy backing in order to impart a suitable stiffness. The mat rests with one end 12 on the floor of a room or on the ground when used out of doors, and is supported at the other end 14 by a box like structure 16 to provide an elevated substantially level portion 18. Hence, the mat includes a first inclined portion 20 and a second elevated, substantially level, portion 18.

An aperture 22, simulating the opening of a golf cup, is provided in the mat at the level portion 18.

Figure 3:
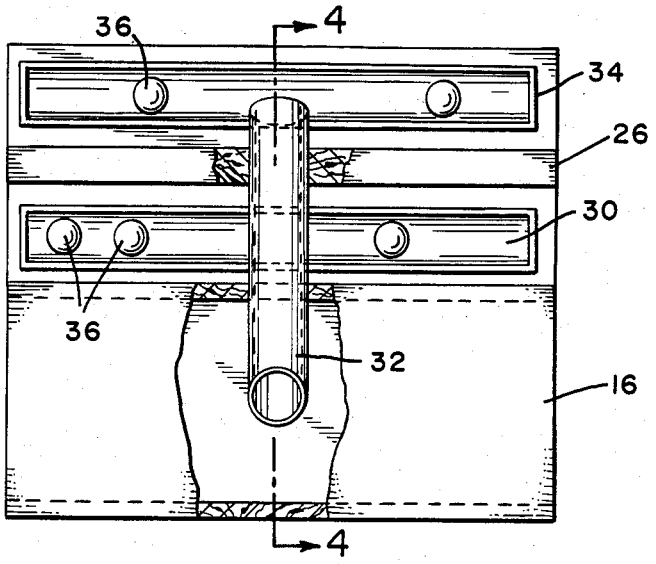
FIG. 3 is a top plan view, partly in section, to show constructional details.
Figure 4:
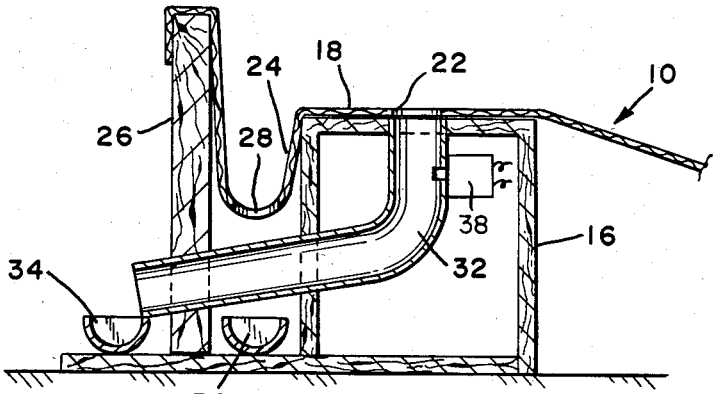
FIG. 4 is a sectional view along line 4—4 in FIG. 3.

While the mat 10 could be terminated at the far end of the elevated level portion 18, in the present example and for the sake of a pleasing appearance, the mat is continued to form a transverse trough portion 24 and then is continued and draped over a vertical wall 26 which acts as a back stop for balls overshooting the mat portion 18. A transverse slot 28 is provided in the mat in the area of the trough portion 24 and a ball receiving receptacle 30 is disposed directly underneath the slot, see also FIGS. 3 and 4. The aperture 22 is connected by means of conveying means, such as a tube 32, to another and similar ball receiving and retaining receptacle 34 for causing golf balls entering the cup simulating aperture 22 to be conveyed by the conveying means 32 to the remote receptacle 34 disposed behind the receptacle 30.

The device will be used substantially as follows: A golf ball 36 is placed near the lower end 12 of the mat 10 and by putting is propelled along the inclined portion 20 of the mat to enter into the aperture 22 which simulates the opening of a regular golf cup. A ball entering the "cup" is conveyed by the tube 32, by gravity, to the receptacle 34 where the ball is retained. Balls missing the aperture 22, but being propelled beyond the position of the aperture 22, fall into the transverse trough portion 24 of the mat and fall through the slot 28 into the other receptacle 30 where they are retained. By counting the balls in receptacle 34 and comparing the quantity of such balls with the balls received in receptacle 30, a competitive score can be developed among several players.

The advantage of using a receptacle 34 resides in the fact that a series of balls can be played without the "cup" being filled up by one or two balls. The conveying means causes the ball to reach a receptacle which is adapted to retain a plurality of balls. Placing the receptacles 30 and 34 next to one another provides convenience for the player when retrieving the balls for a subsequent game.

In a modification, the receptacle 34 can be omitted and a closure provided at the lower end of tube 32. The tube 32 then serves as a receptacle for storing a quantity of balls entering the aperture.

Figure 5:
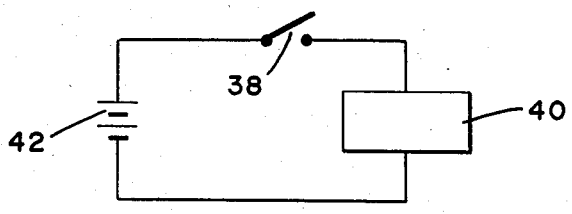
FIG. 5 is an electrical circuit diagram.

In addition, a ball sensing switch 38 can be disposed on the tube 32 to be responsive to a ball being conveyed to the receptacle 34. The sensing switch, as shown in FIG. 5, is coupled to an electrical battery 42 for actuating a counter 40 to establish a visual record of the number of balls having entered the cup. Moreover, the counter can be associated with a printer to issue a printed record at the end of a competitive game. To this end, the counter advantageously includes resetting means for zeroizing the counter after each game.

Instead of using regular golf balls, the present golf practice putting device is suitable also for using golf ball simulating and training devices developed by me heretofore as shown, for instance, in U.S. Pat. Nos. 4,427,254 dated July 14, 1981; 4,494,757 dated Jan. 22, 1985; and 4,402,511 dated Sept. 6, 1983. These devices accentuate putting errors and, therefore, improve the training aspect of the present device.

While there has been described and illustrated a preferred embodiment of my invention and certain modifications have been described, it will be apparent to those skilled in the art that various further changes and modifications may be made without deviating from the broad principle of this invention, which shall be limited only by the scope of the appended claims.

What is claimed is:

1. A golf practice putting device comprising:

an elongated mat upon which a golf ball or golf ball simulating device can be propelled from one end to an opposite elevated end;

means for causing said mat to have a first inclined portion sloping upward from said one end toward said opposite elevated end, and a second elevated substantially level portion;

a cup simulating aperture disposed in said mat at said second portion for receiving a ball propelled from said first end, and a pair of ball receiving and retaining receptacles disposed to the rear of said aperture as viewed from said one end, one of said receptacles communicating with said aperture for receiving and retaining balls received in said aperture, and the other one of said receptacles for receiving and retaining balls rolling over said second portion but failing to be received in said aperture.

2. A golf practice putting device as set forth in claim 1 and including conveying means disposed for conveying a ball received in said aperture to said one receptacle.

3. A golf practice putting device as set forth in claim 2 and a trough portion disposed adjoining said second portion for receiving balls rolling over said second portion but failing to be received in said aperture, and said other receptacle disposed for receiving balls from said trough portion.

4. A golf practice putting device as set forth in claim 3, said trough portion being disposed transverse to the direction of the path of a ball rolling over said second portion.

5. A golf practice putting device comprising:

and elongated mat upon which a golf ball or golf ball simulating device can be propelled from one end to an opposite elevated end;

means for causing said mat to have a first inclined portion sloping upward from said one end toward said opposite elevated end, and a second elevated substantially level portion;

a cup simulating aperture disposed in said mat at said second portion for receiving a ball propelled from said one end;

a pair of ball receiving and retaining receptacles disposed to the rear of said aperture as viewed from said one end, one of said receptacles communicating with said aperture for receiving and retaining balls received in said aperture, and the other one of said receptacles for receiving and retaining balls rolling over said second portion but failing to be received in said aperture, and counting means disposed for counting the balls received in one said ball receiving and retaining receptacles.

6. A golf practice device as set forth in claim 5, said counting means disposed for counting the balls received in said aperture and received in said one receptacle.

7. A golf practice device as set forth in claim 6, and including conveying means disposed for conveying a ball received in said aperture to said one receptacle, said counting means disposed along the path provided by said conveying means.

8. A golf practice device as set forth in claim 7, said counting means including a resettable counter.

* * * * *

UNITED STATES PATENT AND TRADEMARK OFFICE

CERTIFICATE OF CORRECTION

PATENT NO. : 4,634,130

DATED : Jan. 6, 1987

INVENTOR(S) : Luther G. Simjian

It is certified that error appears in the above-identified patent and that said Letters Patent are hereby corrected as shown below:

Column 2, line 5, "not" should read --now--;

Column 3, line 27, "first" should read --one--.

Signed and Sealed this

Seventeenth Day of March, 1987

*Attest:*

DONALD J. QUIGG

*Attesting Officer*

*Commissioner of Patents and Trademarks*